United States Patent [19]

Wietelmann

[11] Patent Number: 4,836,166

[45] Date of Patent: Jun. 6, 1989

[54] ARRANGEMENT FOR CONTROLLING THE METERING OF FUEL TO AN INTERNAL COMBUSTION ENGINE

[75] Inventor: Jürgen Wietelmann, Ditzingen, Fed. Rep. of Germany

[73] Assignee: Robert Bosch GmbH, Stuttgart, Fed. Rep. of Germany

[21] Appl. No.: 4,893

[22] Filed: Jan. 20, 1987

Related U.S. Application Data

[63] Continuation-in-part of Ser. No. 784,264, Oct. 4, 1985, abandoned.

[30] Foreign Application Priority Data

Oct. 4, 1984 [DE] Fed. Rep. of Germany ..... 3436338

[51] Int. Cl.[4] ..... F02M 39/00

[52] U.S. Cl. ..... 123/358; 123/381

[58] Field of Search ..... 123/358, 357, 359, 381, 123/339

[56] References Cited

U.S. PATENT DOCUMENTS

| | | | |
|---|---|---|---|
| 3,170,503 | 2/1965 | Isley | 123/381 |
| 3,204,623 | 9/1965 | Isley | 123/381 |
| 3,407,393 | 10/1968 | Lang | 123/358 |
| 3,699,635 | 10/1972 | Adler | 123/359 |
| 4,174,694 | 11/1979 | Wessel | 123/381 |
| 4,223,654 | 9/1980 | Wessel | 123/358 |
| 4,357,920 | 11/1982 | Stumpp | 123/358 |
| 4,619,233 | 10/1986 | Yamaguchi | 123/357 |

FOREIGN PATENT DOCUMENTS

| | | | |
|---|---|---|---|
| 0185832 | 10/1984 | Japan | 123/381 |

*Primary Examiner*—Carl Stuart Miller
*Attorney, Agent, or Firm*—Walter Ottesen

[57] ABSTRACT

An arrangement is disclosed for controlling the metering of fuel to an internal combustion engine. The control can be open-loop and/or closed-loop and the amount of fuel metered to the engine is limited by means of a full-load limiter dependent on at least the rotational speed of the engine. The arrangement further includes a substitute full-load limiter for limiting the amount of fuel metered to the engine. It is particularly advantageous for the substitute full-load limiter to operate in dependence on the engine temperature and/or the fuel temperature, with a linear function of these parameters representing a further embodiment of the invention. Block diagrams of the arrangement of the invention and characteristic fields explain its mode of operation.

14 Claims, 4 Drawing Sheets

ARRANGEMENT FOR CONTROLLING THE METERING OF FUEL TO AN INTERNAL COMBUSTION ENGINE

RELATED APPLICATION

This is a continuation-in-part of the application Ser. No. 784,264 filed Oct. 4, 1985 and entitled "Arrangement for Controlling the Metering of Fuel to an Internal Combustion Engine", now abandoned.

FIELD OF THE INVENTION

The invention relates to an arrangement for controlling the metering to an internal combustion engine. The arrangement includes a full-load limit for limiting the metering of fuel to the engine which is at least dependent on rotational speed.

BACKGROUND OF THE INVENTION

An arrangement is disclosed in U.S. Pat. No. 4,624,230 wherein the amount of fuel deliverable to the internal combustion engine is limited at least in dependence on the rotational speed of the internal combustion engine. This full-load limitation described in this patent application uses a characteristic field which is at least two-dimensional and indicates the maximum amount of fuel deliverable to the internal combustion engine for each operating condition of the engine. As long as this full-load limitation uses a two-dimensional or three-dimensional characteristic field, it is possible to compute the corresponding characteristic field value in an electronic control unit at the point in time that the operating condition occurs within a reasonable time period. However, to be able to determine accurately the full-load fuel quantity for each operating condition, several two-dimensional, three-dimensional or even multi-dimensional characteristic fields connected in series and/or in parallel are required. Yet the time required for computing this fuel quantity exceeds the permissible time between two injections. In the idle-speed control range, for example, the result is that the dead time of the idle-speed control increases, which causes the dynamics of the idle-speed control to deteriorate substantially.

SUMMARY OF THE INVENTION

In contrast with the prior art described and referred to above, the arrangement of the invention for the open-loop and/or closed-loop control of the fuel metering in an internal combustion engine affords the advantage of providing a definite value for the maximum amount of fuel to be delivered to the internal combustion engine at any point in time when fuel is supplied thereto and for any one of its operating conditions. This is accomplished by providing, in addition to the known full-load limiter described, a substitute full-load limiter to limit the amount of fuel metered into the internal combustion engine.

The arrangement according to the invention controls the fuel metered to an internal combustion engine and includes: first full-load limiting means for limiting the quantity of fuel metered to the engine during full-load operation in dependence upon at least the rotational speed of the engine; substitute full-load limiting means for limiting the quantity of fuel metered to the engine and having limiting values dependent upon the operating temperature of the engine; and, means for applying the substitute full-load limiting means for limiting the quantity of fuel when the engine is in an operating condition for which the fuel to be metered to the engine is above a lower limit ($Q_{K3MIN}$) of the substitute full-load limit and below an upper limit ($Q_{K3MAX}$) of the substitute full-load limit.

It is particularly advantageous in this arrangement to have this substitute full-load fuel limiter operate in dependence on the engine temperature and/or the fuel temperature. Another advantageous feature of the invention is a linear dependence of the substitute full-load limiter on at least one of the two parameters last mentioned. Pursuant to a preferred embodiment of the invention, the substitute full-load limiter has limit values dependent upon a linear combination of both engine temperature and fuel temperature.

Further advantages of the invention will become apparent from the subsequent description of embodiments of the invention in conjunction with the drawing and from the claims.

BRIEF DESCRIPTION OF THE DRAWINGS

The invention will now be described with reference to the drawings wherein.

DESCRIPTION OF THE PREFERRED EMBODIMENTS OF THE INVENTION

The embodiments described in the following refer to diesel engines by way of example. They are, however, not principally restricted to these but may be used generally in connection with internal combustion engines. The embodiments are described with reference to block diagrams and characteristic fields. For implementation of these block diagrams and characteristic fields, several possibilities exist; thus, for example, the entire arrangement may be configured in the form of analog electronic circuit means supplemented, where necessary, by mechanical devices. Likewise, it is possible to implement the entire arrangement by means of a suitably programmed digital computer, that is, circuit means mainly made up of digital elements. Finally, the arrangement of the invention is not limited to the parameters used in the subsequent description of embodiments of the invention; instead, it is also possible to use it in connection with other technical quantities.

Figure 1:
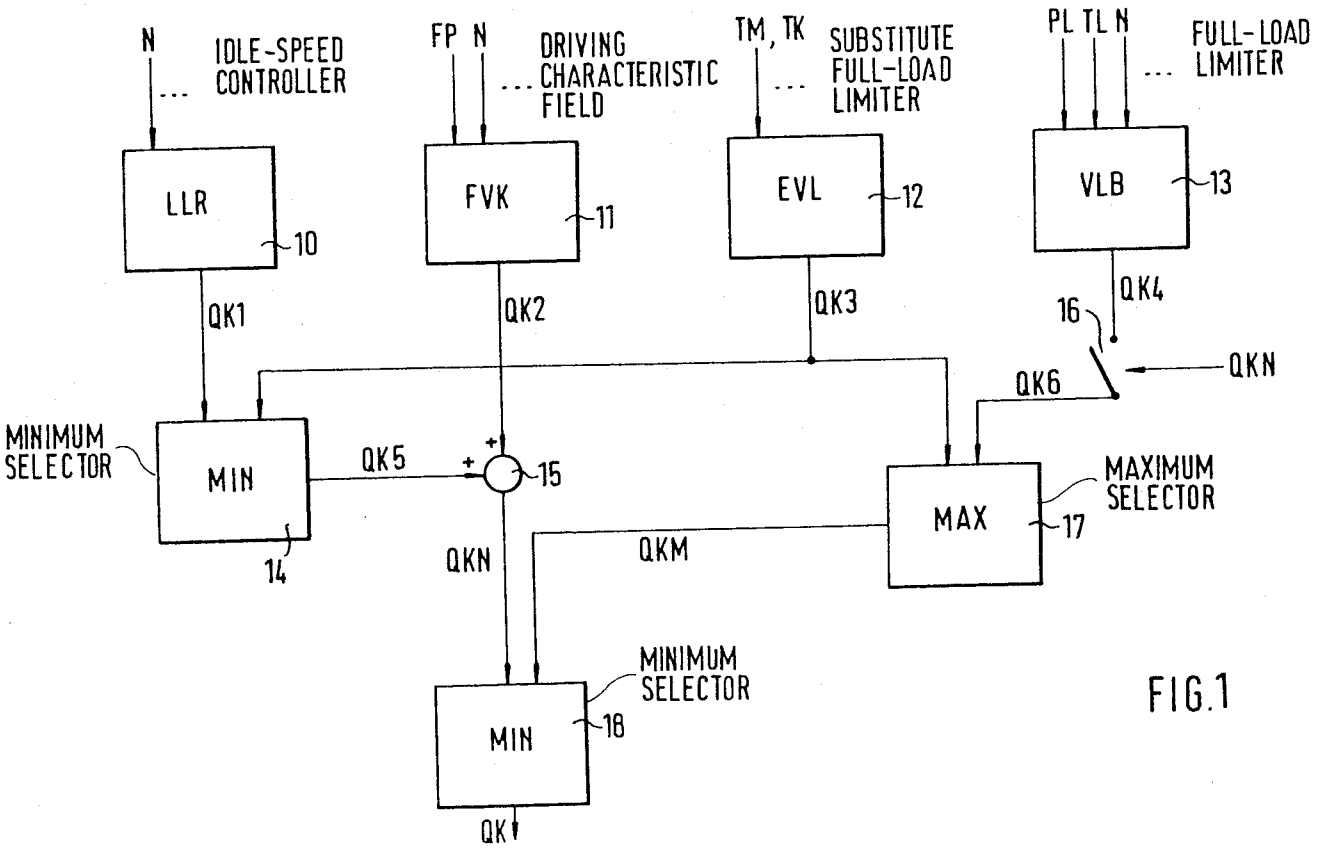
FIG. 1 is a block diagram of an embodiment of the arrangement of the invention which includes a full-load limiter.

FIG. 1 shows an embodiment of the arrangement of the invention. In FIG. 1, an idle-speed controller 10, a driving characteristic field 11, a substitute full-load limiter 12 and a full-load limiter 13 generate respective output signals QK1, QK2, QK3 and QK4. Signals QK1 and QK3 are applied to minimum selector 14 which generates an output signal QK5 in dependence on these signals. Adder 15 combines the two signals QK5 and QK2 to form signal QKN. Signal QK4 is connected to a switch 16 which is actuated in dependence on signal QKN. The switch output signal is identified by QK6. The two signals QK3 and QK6 are applied to maximum selector 17 the output of which is signal QKM. Finally, the two signals QKN and QKM are connected to minimum selector 18 producing an output signal QK in dependence on these two input signals.

In the embodiment of the arrangement of the invention of FIG. 1, idle-speed controller 10 depends at least on the rotational speed N of the internal combustion engine, the driving characteristic field 11 depends at least on the accelerator pedal position FP and the rotational speed N, the substitute full-load limiter 12 depends at least on the engine temperature TM and/or the fuel temperature TK, and the full-load limiter 13 depends at least on the charge-air pressure PL, the charge-air temperature TL and the rotational speed N of the internal combustion engine.

Figure 2:
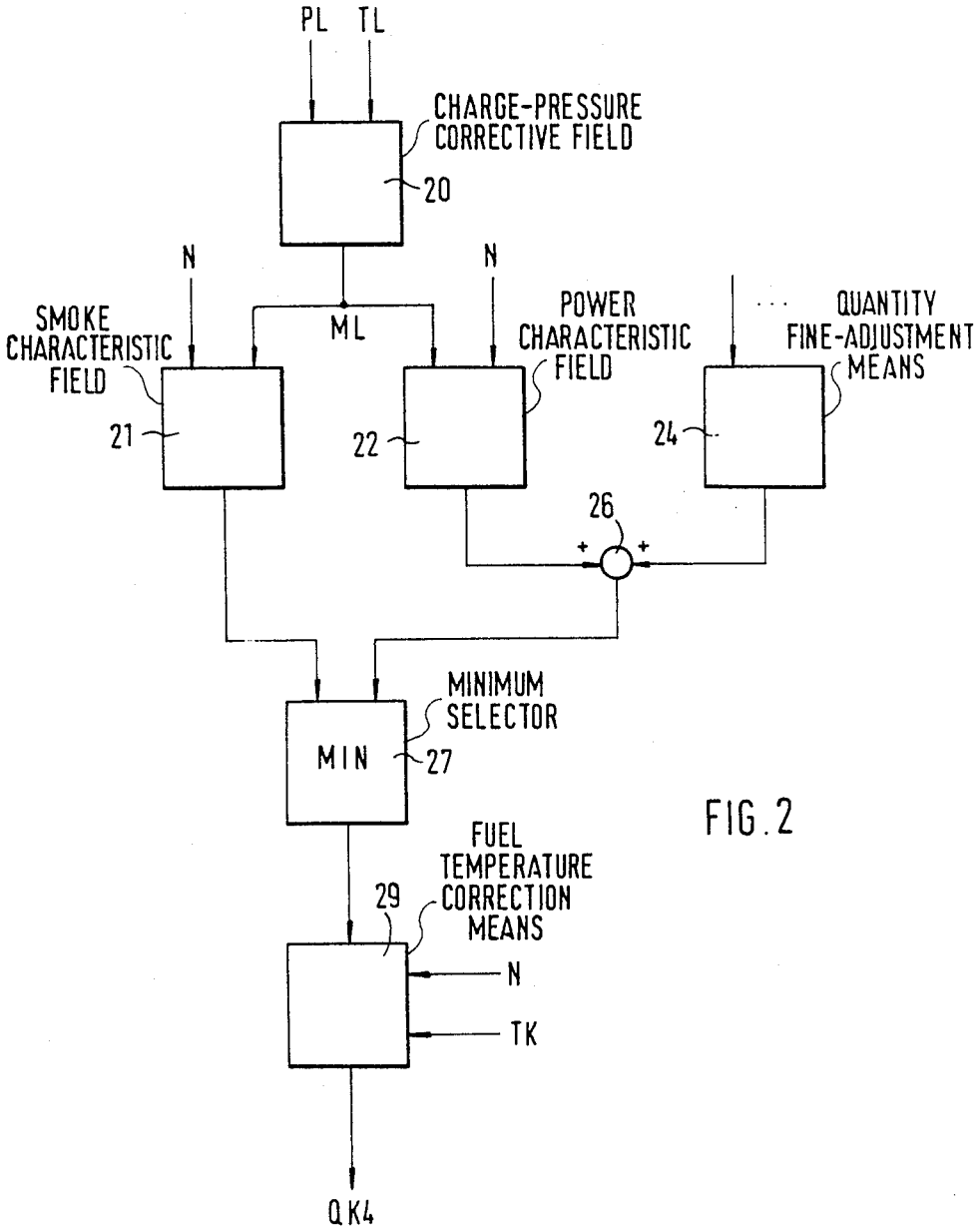
FIG. 2 is a block diagram of an embodiment of the full-load limiter of the arrangement of FIG. 1.

FIG. 2 shows an embodiment of the full-load limiter 13 of FIG. 1. In FIG. 2, a charge-pressure corrective characteristic field 20 generates, in dependence on its two input signals which are the charge-air pressure PL and the charge-air temperature TL, an output signal ML which is indicative of the charge-air quantity. This charge-air quantity ML is applied to smoke characteristic field 21 and to power characteristic field 22. The rotational speed N of the internal combustion engine is another input signal into the last-mentioned characteristic fields 21 and 22. In dependence on charge-air quantity ML and rotational speed N of the engine, smoke characteristic field 21 and power characteristic field 22 thus produce respective output signals. The output signal of smoke characteristic field 21 is connected to a minimum selector 27; whereas, the output signal of power characteristic field 22 is applied to an adder 26.

Another signal applied to the input of adder 26 is the output signal of a quantity fine adjusting means 24 which is dependent on the operating condition of the engine. Adder 26 generates an output signal from its two input signals which is supplied to minimum selector 27. Fuel-temperature correction means 29 receives the output signal from minimum selector 27 on the one hand, and the rotational speed N and the fuel temperature TK on the other hand. From these input signals, fuel-temperature correction means 29 generates an output signal QK4 which corresponds to the output signal of the full-load limiter 13 of FIG. 1.

Figure 3:
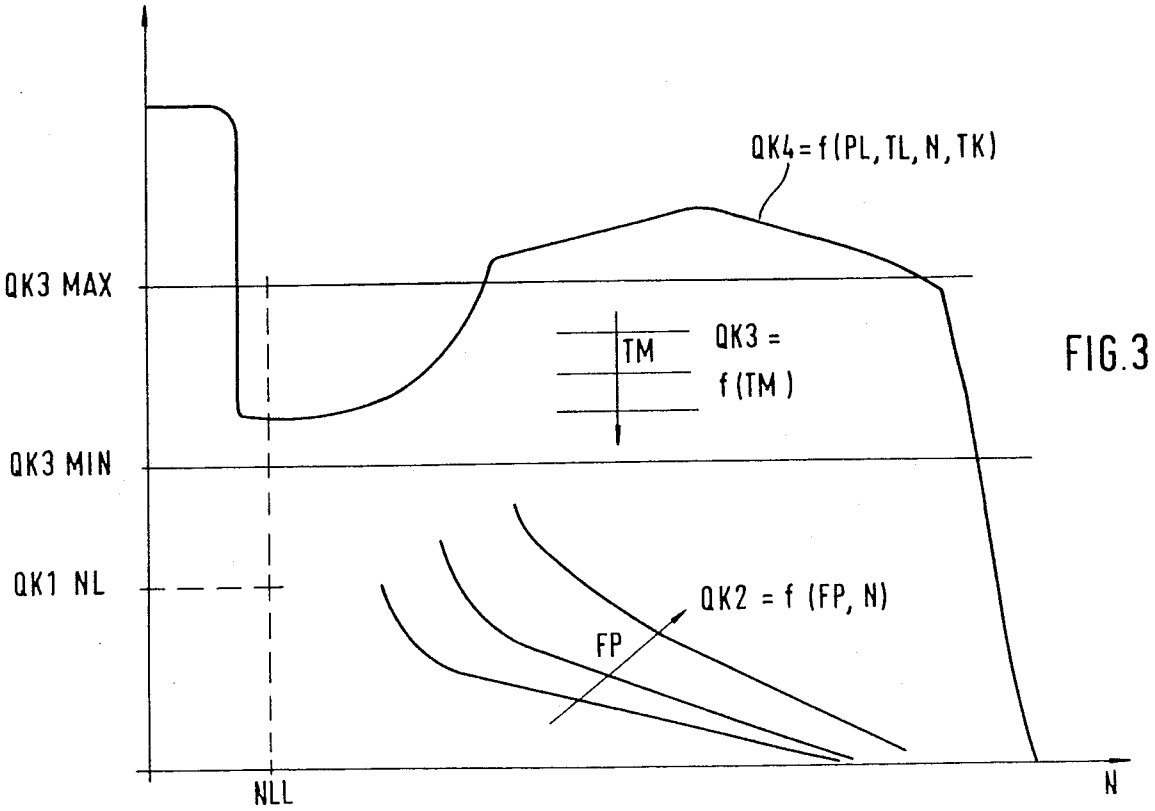
FIG. 3 is a driving characteristic field of the arrangement of the invention; and, FIG. 4 is a characteristic field showing full-load and substitute full-load limitations.
Figure 4:
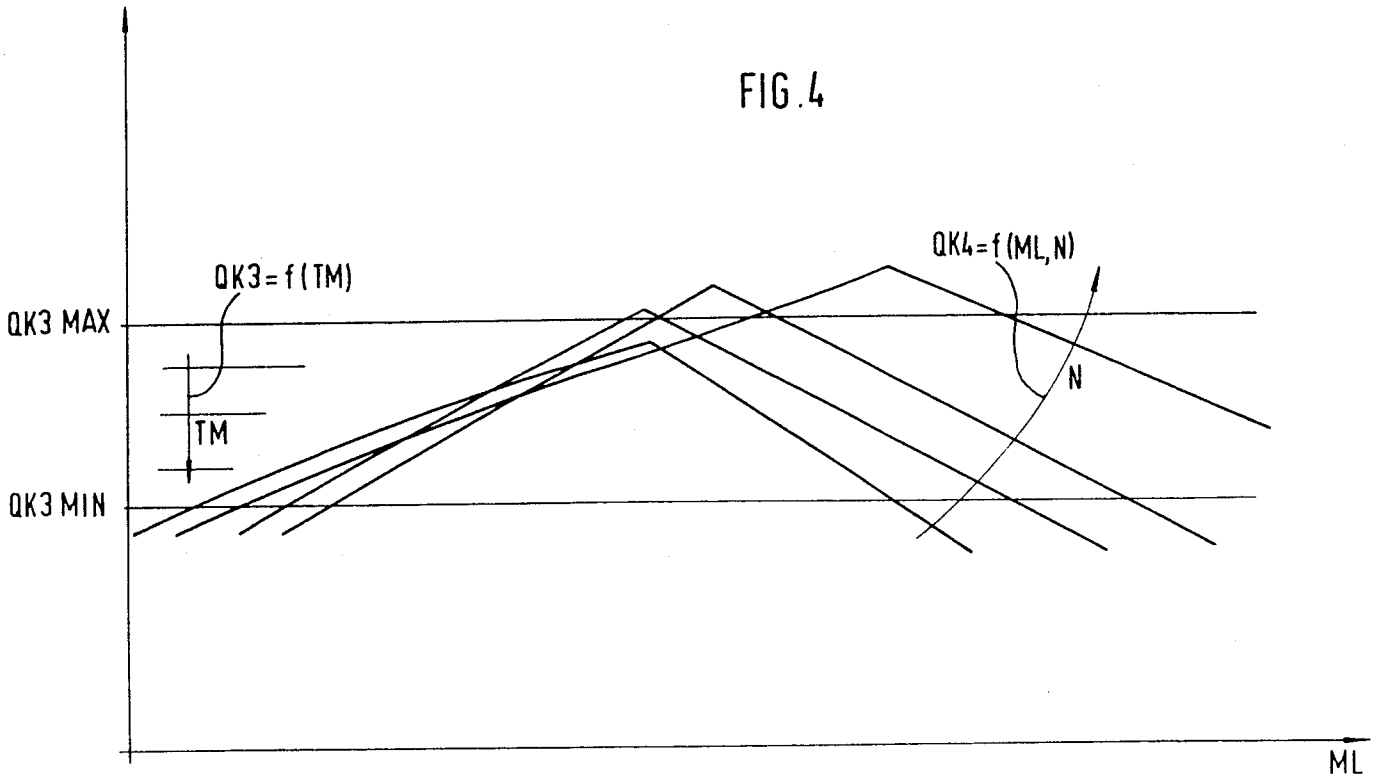

The mode of operation of the two block diagrams of FIGS. 1 and 2 will now be described with reference to the characteristic fields of FIGS. 3 and 4. FIG. 3 shows a driving characteristic field of the arrangement of the invention, while FIG. 4 illustrates a full-load limitation and a substitute full-load limitation. In the two FIGS. 3 and 4, NLL identifies the idle speed of the internal combustion engine; QK3MAX refers to a specific value of signal QK3 at a specific engine temperature TM, for example, at TM = −10° C.; QK3MIN identifies a specific value of signal QK3 at a specific engine temperature TM, for example, at TM = +20° C.; and, QK1NL refers to a specific value of signal QK1 at no-load, that is, with the engine warm, unloaded and idling. The values named may, of course, vary in dependence on the operating condition of the internal combustion engine, for example, NLL = f(TM), et cetera. All further reference symbols in FIGS. 3 and 4 are identical to the corresponding reference symbols of FIGS. 1 and 2.

Within the range of idle speed NLL, the metering of fuel to the internal combustion engine is primarily influenced by the idle-speed controller 10 of FIG. 1. As becomes apparent from FIG. 3, idle-speed controller 10 meters the fuel quantity QK1NL to the engine with the engine at idle speed NLL, warm and unloaded. If, however, the internal combustion engine is not at no-load, requiring it, for example, to operate against an increased friction as a result of a lower engine operating temperature, idle-speed controller 10 will increase the amount of fuel to be metered to the engine above the value QK1NL.

In the prior art, the upper limit for the fuel to be delivered to the internal combustion engine at idle has always been defined by the full-load limiter, that is, by value QK4 at the corresponding engine speed in FIG. 3. This has, however, the disadvantage that with the engine very cold, for example, the fuel delivery at idle is limited to a value insufficient for operation of the engine, that is, the engine dies. Also, it may happen that after a sudden release of load with the engine operationally warm and loaded, an excessive amount of idle-fuel quantity is metered to the engine thereby causing the engine to accelerate abruptly.

The arrangement of the invention eliminates these disadvantages of prior-art devices in that according to FIG. 3 the idle-speed controller, particularly its integral component, is not limited by the value of signal QK4 but by the value of signal QK3 = f(TM). In this arrangement, signal QK3 is generated by the substitute full-load limiter 12 of FIG. 1. In a particularly advantageous manner, signal QK3 is linearly dependent on the engine temperature TM. It is also possible to use the fuel temperature TK as parameter for signal QK3 in lieu of, or in addition to, the engine temperature TM. As becomes apparent from FIG. 3, signal QK3 assumes a high value, which is maximally the value QK3MAX, with the engine cold, that is, with TM low. The value of signal QK3 decreases as the engine temperature TM increases. With the internal combustion engine warm, QK3 reaches its lowest value which is QK3MIN.

Limiting the idle-speed controller 10 of FIG. 1, particularly the integral component thereof, has the advantage that with the internal combustion engine still very cold, the idle-fuel quantity can increase to a very high value, that is, to QKMAX, as a result of which the idle speed NLL can be maintained against the high frictional resistance of the cold engine thereby preventing it from stalling. By contrast, with the internal combustion engine warm, the idle-fuel quantity is limited to a small value, that is, to QK3MIN; as a result, after a sudden release with the engine idling and loaded, the idle-fuel quantity is not excessive, that is, the engine will not accelerate.

Overall, therefore, minimum selector 14 always limits the idle-speed controller 10 of FIG. 1, particularly its integral component, to QK3 = f(TM), that is, to the substitute full-load limit according to FIG. 3. As a result, the time-consuming computation of the full-load limit of FIG. 2 is not necessary for idle-speed control; instead, the simple computation of the substitute full-load limit is sufficient. Therefore, increases in the dead time of the idle-speed control and the deteriorations in the controller dynamics associated therewith no longer occur in the idle-speed control.

The amount of fuel to be delivered to the internal combustion engine during the driving operation of the engine is metered to the internal combustion engine in accordance with the block diagram of FIG. 1. Because of the increased rotational speed, the output signal QK1 of idle-speed controller 10 will assume its lower limit value, that is normally the value zero.

The driving characteristic field 11 influences the amount of fuel to be metered with its accelerator-dependent output signal QK2. By means of minimum selector 18, the fuel quantity to be metered to the internal combustion engine is then limited. The limit is produced with the aid of the full-load limiter 13 and the substitute full-load limiter 12, with the larger one of the two output signals QK3 and QK6 always forming the maximum fuel quantity QKM. FIG. 3 shows the signals QK2, QK3 and QK4 in dependence on their respective parameters. In order to ensure that maximum selector 17 always selects the larger one of the two values QK3 and QK6, it would be necessary to carry out the time consuming computation of the full-load limit 13 of FIG. 2 for every point in time when fuel is metered. Under specific conditions, however, this is not necessary. At any point in time that fuel is metered, the arrangement of FIG. 1 of the invention supplies a signal QK which ultimately determines the amount of fuel to be delivered to the internal combustion engine. This signal mostly corresponds to signal QKN, unless the fuel quantity is at its limit, that is, QKN =QKM. When signal QKN is compared with signal QK3 and if QKN is less than QK3, this operating condition of the internal combustion engine does not require computation of the full-load limit 13 of FIG. 2. This is made possible because in this particular operating condition in the engine speed ranges in which QK6 is less than QK3, the substitute full-load limiter 12, and thus QK3, would come to bear on account of maximum selector 17, and because in the engine speed ranges in which QK6 is greater than QK3, the full-load limiter 13 and thus QK6 does not come to bear, since QKN is less than the output signal QK3 of the substitute full-load limiter 12. Only if QKN≧QK3 is it necessary to compute the value QK4 of full-load limiter 13 because it is from this point in time on, at least in specific engine speed ranges, that the substitute full-load limiter 12, and thus signal QK3, is no longer sufficient.

The dependence of the computation of value QK4 upon signal QKN is shown in FIG. 1 by means of switch 16. Thus, as soon as signal QKN is equal to or even greater than signal QK3, signal QK4 is generated, and signal QKM will be produced with the aid of maximum selector 17 as shown in FIG. 1.

Consequently, the substitute flll-load limiter 12 of the invention makes it possible to dispense with the time-consuming computation of full-load limit 13 (as shown in FIG. 2) during specific operating conditions of the internal combustion engine, that is, as long as signal QKN is less than signal QK3 as shown in FIG. 1. Since the substitute full-load limit 12 can be computed substantially faster, control circuit dead times are avoided also during normal driving conditions of the internal combustion engine, and the controller dynamic is not adversely affected thereby. In those operating conditions, however, in which it is necessary to compute the time-consuming full-load limit 13, the controller dynamic of the entire engine does not deteriorate as a result of increased control circuit dead times; however, since these operating conditions only occur at high loads of the engine, this adverse effect is to a large extent compensated for by this load and thereby by the resulting control feedback of the engine.

Finally, the alternate action of full-load limiter 13 and substitute full-load limiter 12 shall be explained again with reference to FIG. 4. In FIG. 4, signals QK3 and QK4 are plotted against the charge-air quantity ML. For signals QK3 and QK4, parameter TM and N, respectively, are also plotted. Maximum selector 17 of FIG. 1 always selects the greater one of the two values QK3 and QK6 for limiting signal QKN. If, however, the signal QKN which is to be limited is less than the signal QK3, the computation of signal QK4 is unnecessary because signal QK3 suffices for limitation. Only if the signal QKN which is to be limited becomes equal to or even greater than signal QK3, is it necessary to compute signal QK4 and to select limit signal QKM with the aid of maximum selector 17 from the two signals QK3 and QK6. In connection with FIG. 1 and the explanations given in the foregoing, the following mathematical equations result:

$$QK=MIN(QKN, QKM)$$

$$QKN=QK5+QK2$$

$$QK5=MIN(QK1, QK3)$$

$$QKM=QK3 \text{ for } QKN<QK3$$

$$QKM=MAX(QK3, QK6) \text{ for } QKN\geqq QK3$$

$$QK6=QK4 \text{ for } QKN\geqq QK3$$

$$QK1=f(N, \ldots)$$

$$QK2=f(FP, N, \ldots)$$

$$QK3=f(TM, TK, \ldots)$$

$$QK4=f(PL, TL, N, \ldots)$$

In summary, with the invention, the determination of the full-load limit in specific operating conditions of the engine is simplified and is not computed in the conventional manner from several characteristic fields. The conventional full-load limit ($Q_{K4}$ in FIG. 3) must always be precisely determined when a desired quantity ($Q_{K2}$) is detected in the full-load range from an accelerator pedal position. In definite operating conditions, however, which lie in the range limited by the two boundaries $Q_{K3MAX}$ and $Q_{K3MIN}$, a time consuming computation need not be made. In this way, stability of the control loop is achieved. In such a case, the limit $Q_{K3MAX}$ serves as the full-load limit. In connection with the above, the two limits $Q_{K3MAX}$ and $Q_{K3MIN}$ are dependent upon the operating temperature of the machine, of the temperature of the fuel or a linear combination of both temperatures which constitutes a further advantage of the invention.

It is understood that the foregoing description is that of the preferred embodiments of the invention and that various changes and modifications may be made thereto without departing from the spirit and scope of the invention as defined in the appended claims.

What is claimed is:

1. An arrangement for controlling fuel metered to an internal combustion engine, the arrangement comprising:

first full-load limiting means for generating a limit signal (QK4) to limit the quantity of fuel metered to the engine during full-load operation in dependence upon at least the rotational speed of the engine and only during predetermined operating conditions thereof;

substitute full-load limiting means for generating a limit signal (QK3) to limit the quantity of fuel metered to the engine during idle and the values of said limit signal (QK3) being dependent solely upon the operating temperature of the engine and the temperature of the fuel thereby preventing the engine from stalling when cold;

idle-speed controller means for generating an output signal (QK1);

minimum selector means for receiving said output signal (QK1) and said limit signal (QK3) for generating an output signal (QK5) in dependence upon said signals (QK1 and QK3);

driving characteristic field means for generating an output signal (QK2);

summing means for combining said output signal (QK5) and said output signal (QK2) to generate signal (QKN);

means for comparing said signal (QKN) to said limit signal (QK3) and permitting said limit signal (QK4) to be generated only when said signal QKN is equal to or greater than said signal (QK3); and, means for applying said substitute full-load limiting means for limiting the quantity of fuel when the engine is in an operating condition for which the fuel to be metered to the engine is above the lower limit ($Q_{K3MIN}$) of the substitute full-load limit and below the upper limit ($Q_{K3MAX}$)of the substitute full-load limit.

2. The arrangement of claim 1, said substitute full-load limiting means having limiting values dependent upon said operating temperature of the engine and the temperature of the fuel.

3. The arrangement of claim 2, said substitute full-load limiting means having limiting values dependent upon a linear combination of said operating temperature of the engine and said operating temperature of the fuel.

4. The arrangement of claim 1, wherein said first full-load limiting means and said substitute full-load limiting means replace each other.

5. The arrangement of claim 4 comprising maximum selection means for making the replacement.

6. The arrangement of claim 1, comprising no-load control means for controlling the no-load operation of the engine and wherein the fuel metered to the engine is limited as a consequence of said no-load control means with aid of said substitute full-load limit means.

7. The arrangement of claim 6, said no-load control means including an integral component and wherein said integral component is limited with the aid of said substitute full-load limit means.

8. The arrangement of claim 2, wherein the value of the substitute full-load limit means is reduced with increasing engine temperature and/or increasing fuel temperature.

9. The arrangement of claim 8, said last-mentioned value having a maximum boundary value and a minimum boundary value.

10. The arrangement of claim 9, said maximum boundary value and said minimum boundary value being selected in dependence upon the particular internal combustion engine.

11. The arrangement of claim 10, wherein said maximum boundary value and said minimum boundary value are selected in dependence upon the operating characteristic quantities of the engine.

12. The arrangement of claim 1, wherein the full-load limit dependent at least upon rotational speed is calculated only when it is necessary for limiting the metering of fuel to the engine.

13. An arrangement for controlling fuel metered to an internal combustion engine, the arrangement comprising:

first full-load limiting means for generating a limit signal (QK4) to limit the quantity of fuel metered to the engine during full-load operation in dependence upon at least the rotational speed of the engine and only during predetermined operating conditions thereof;

substitute full-load limiting means for generating a limit signal (QK3) to limit the quantity of fuel metered to the engine during idle and the values of said limit signal (QK3) being dependent soley upon the operating temperature of the engine thereby preventing the engine from stalling when cold;

idle-speed controller means for generating an output signal (QK1);

minimum selector means for receiving said output signal (QK1) and said limit signal (QK3) for generating an output signal (QK5) in dependence upon said signals (QK1 and QK3);

driving characteristic field means for generating an output signal (QK2);

summing means for combining said output signal (QK5) and said output signal (QK2) to generate signal (QKN);

means for comparing said signal (QKN) to said limit signal (QK3) and permitting said limit signal (QK4) to be generated only when said signal (QKN) is equal to or greater than said signal (QK3); and, means for applying said substitute full-load limiting means for limiting the quantity of fuel when the engine is in an operating condition for which the fuel to be metered to the engine is above the lower limit ($Q_{K3MIN}$) of the substitute full-load limit and below the upper limit ($Q_{K3MAX}$) of the substitute full-load limit.

14. An arrangement for controlling fuel metered to an internal combustion engine, the arrangement comprising:

first full-load limiting means for generating a limit signal (QK4) to limit the quantity of fuel metered to the engine during full-load operation in dependence upon at least the rotational speed of the engine and only during predetermined operating conditions thereof;

substitute full-load limiting means for generating a limit signal (QK3) to limit the quantity of fuel metered to the engine during idle and the values of said limit signal (QK3) being dependent soley upon the temperature of the fuel thereby preventing the engine from stalling when cold;

idle-speed controller means for generating an output signal (QK1);

minimum selector means for receiving said output signal (QK1) and said limit signal (QK3) for generation an output signal (QK5) in dependence upon said signals (QK1 and QK3);

driving characteristic field means for generating an output signal (QK2);

summing means for combining said output signal (QK5) and said output signal (QK2) to generate signal (QKN);

comparison means for comparing said signal (QKN) to said limit signal (QK3) and permitting said limit signal (QK4) to be generated only when said signal (QKN) is equal to or greater than said signal (QK3); and, means for applying said substitute full-load limiting means for limiting the quantity of fuel when the engine is in an operating condition for which the fuel to be metered to the engine is above the lower limit ($Q_{K3MIN}$) of the substitute full-load limit and below the upper limit ($Q_{K3MAX}$) of the substitute full-load limit.

* * * * *

UNITED STATES PATENT AND TRADEMARK OFFICE

CERTIFICATE OF CORRECTION

PATENT NO. : 4,836,166

DATED : June 6, 1989

INVENTOR(S) : Jürgen Wietelmann

It is certified that error appears in the above-identified patent and that said Letters Patent is hereby corrected as shown below:

On the title page, under "References Cited": delete "3,699,635 10/1972 Adler . . ." and substitute -- 3,699,935 10/1972 Adler . . . -- therefor.

In column 5, line 43: delete "flll-load" and substitute -- full-load -- therefor.

In column 8, line 43: delete "soley" and substitute -- solely -- therefor.

In column 8, line 49: delete "ation" and substitute -- ating -- therefor.

Signed and Sealed this

Eighth Day of May, 1990

*Attest:*

HARRY F. MANBECK, JR.

*Attesting Officer*

*Commissioner of Patents and Trademarks*